US005682698A

United States Patent [19]

Bevins

[11] Patent Number: 5,682,698

[45] Date of Patent: Nov. 4, 1997

[54] SIGN HOLDER FOR SHELVES WITH C-CHANNELS

[75] Inventor: Earle Bevins, Chicago, Ill.

[73] Assignee: Fast Industries, Inc., Fort Lauderdale, Fla.

[21] Appl. No.: 682,181

[22] Filed: Jul. 17, 1996

[51] Int. Cl.[6] ..... G09F 3/18

[52] U.S. Cl. ..... 40/661.03; 40/661; 40/661.08

[58] Field of Search ..... 40/642.01, 654.01, 40/658, 661, 661.03, 661.08, 666, 642.02

[56] References Cited

U.S. PATENT DOCUMENTS

| | | | |
|---|---|---|---|
| 2,592,386 | 4/1952 | Breakey | 40/658 |
| 3,977,112 | 8/1976 | Breer, II . | |
| 4,485,575 | 12/1984 | Fast . | |
| 4,545,140 | 10/1985 | Winston . | |
| 4,671,002 | 6/1987 | Fast . | |
| 4,716,669 | 1/1988 | Fast . | |
| 4,718,627 | 1/1988 | Fast et al. . | |
| 5,419,066 | 5/1995 | Harnois et al. . | |
| 5,488,793 | 2/1996 | Gebka et al. . | |
| 5,511,332 | 4/1996 | Sturkie et al. | 40/661.03 |

FOREIGN PATENT DOCUMENTS

| | | | |
|---|---|---|---|
| 2101387 | 1/1983 | United Kingdom | 40/101 |

OTHER PUBLICATIONS

Fasteners For Retail, 1996 Buyers Guide for Prices effective Jan. 1, 1996, pp. 1–83.

Fast Industries, Label Holders & Merchandisers Catalog & Price List.

Fast Extruding & Molding, Retail Label Holders and Sign Holders, Catalog, vol. 2.

Fast Industrial Bar Code Label Holders, Catalog/Price List, vol. 3, pp. 1–9.

Fast Industries, Inc. Label Holders, Strip Merchandisers, Sign Holders, P.O.P. Accessories, Shelf Dividers, Merchandising Aids, Catalog vol. 1, pp. 1–45.

Fast Extruding & Molding, EZ–View® Label Placement & Merchandising Systems, Catalog—vol. 1, pp. 1–19.

*Primary Examiner*—Brian K. Green

*Attorney, Agent, or Firm*—Jacobson, Price, Holman & Stern, PLLC

[57] ABSTRACT

A plastic sign holder is designed to fit in C-channels of different heights along front edges of respective merchandise display shelves. The holder is a plastic sheet with downwardly folded flaps of different heights at the top and bottom edges. The flaps are adapted to the heights of the respective channels so that the holder can be reversed for selective use in either channel. Either way, one of the flaps fits hook-wise in the respective channel so that the holder depends downwardly to a level below the channel. The other flap forms an upwardly facing pocket at the bottom of the holder and a sign or label can be fitted between the flaps against the back face or the holder.

5 Claims, 1 Drawing Sheet

SIGN HOLDER FOR SHELVES WITH C-CHANNELS

BACKGROUND OF THE INVENTION

This invention relates to a sign holder for use with merchandise display shelves of the type in which the shelves have C-channels formed along the front edge.

Shelves with C-channels are commonly formed in merchandise outlets such as supermarkets and the like and the C-channels form a convenient means for mounting labels, signs or sign holders which provide information relating to merchandise displayed on a shelf. A C-channel, being formed with upper and lower lips, is suitable for mounting many different kinds of fit-in articles such as signs, sign holders and the like, and the prior art is replete with numerous designs for such articles.

One criterion which is applicable to the design of articles such as signs and sign holders adapted to be fitted into a C-channel, is the size, particularly the height, of the channel itself, since variations in channel height can affect the fit of an article in the channel. There may, for example, be small variations in height between different C-channels having nominally the same dimensions or, alternatively, different shelves may have different size C-channels. Accordingly, variations in C-channel dimensions need be taken into account in the design of fit-in sign holders and the like.

SUMMARY OF THE INVENTION

It is an object of the invention to provide a sign holder of simple and economical manufacture which can be used on shelves having C-channels of somewhat differing heights.

Accordingly, the invention provides a sign holder comprising a sheet of plastic having a front face and a back face, upper and lower edges and backwardly folded flaps or flanges of differing heights at the top and bottom edges, the flaps or flanges being adapted to the heights of different C-channels respectively.

In use, one or other of the flaps is fitted in a C-channel of suitable height to which it is adapted, with the sign holder depending downwardly therefrom to a level below the C-channel and so that the other flap forms an upwardly facing pocket. The sign holder is firmly secured in the C-channel by means of the top flap, and a sign or card of suitable dimensions can be fitted between the flaps against the back face of the holder.

The sign holder can alternatively be reversed for using the other flap to mount the holder in a different C-channel having a height to which the other flap is adapted.

Additional features and advantages of the invention will become apparent from the ensuing description and claims read in conjunction with the attached drawings.

DETAILED DESCRIPTION OF THE PREFERRED EMBODIMENTS

Figure 1:
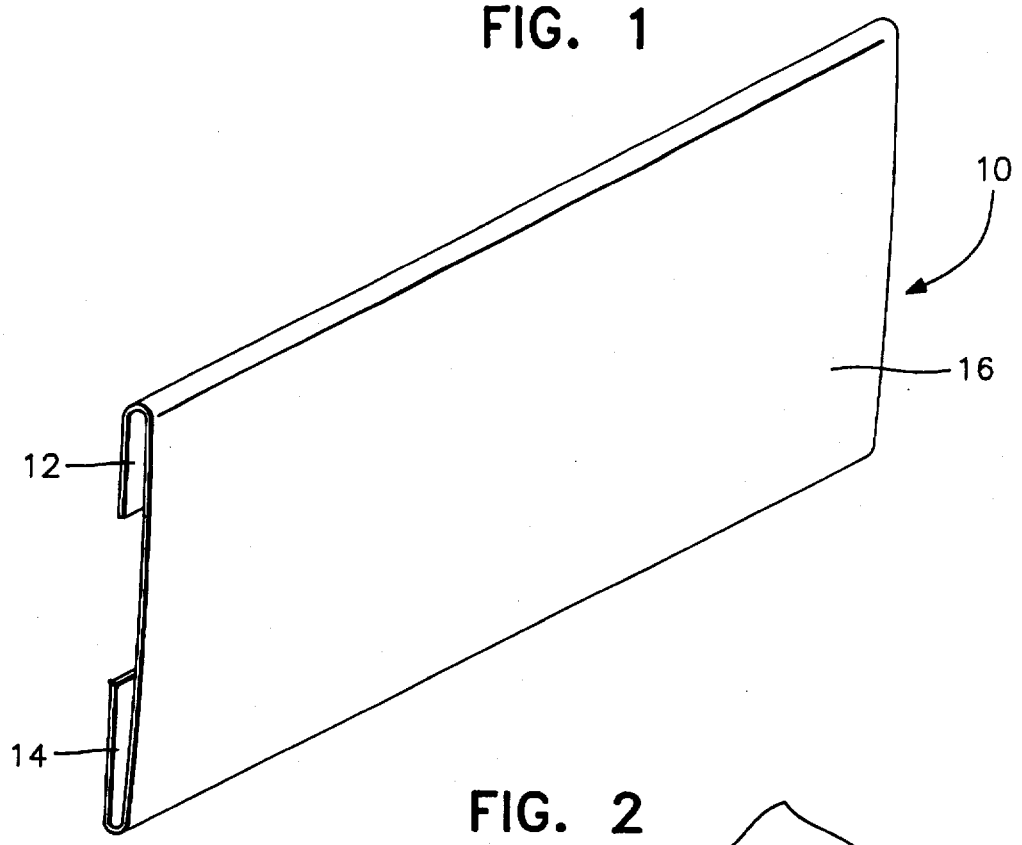
FIG. 1 is a perspective view of a sign holder according to the invention.
Figure 2:
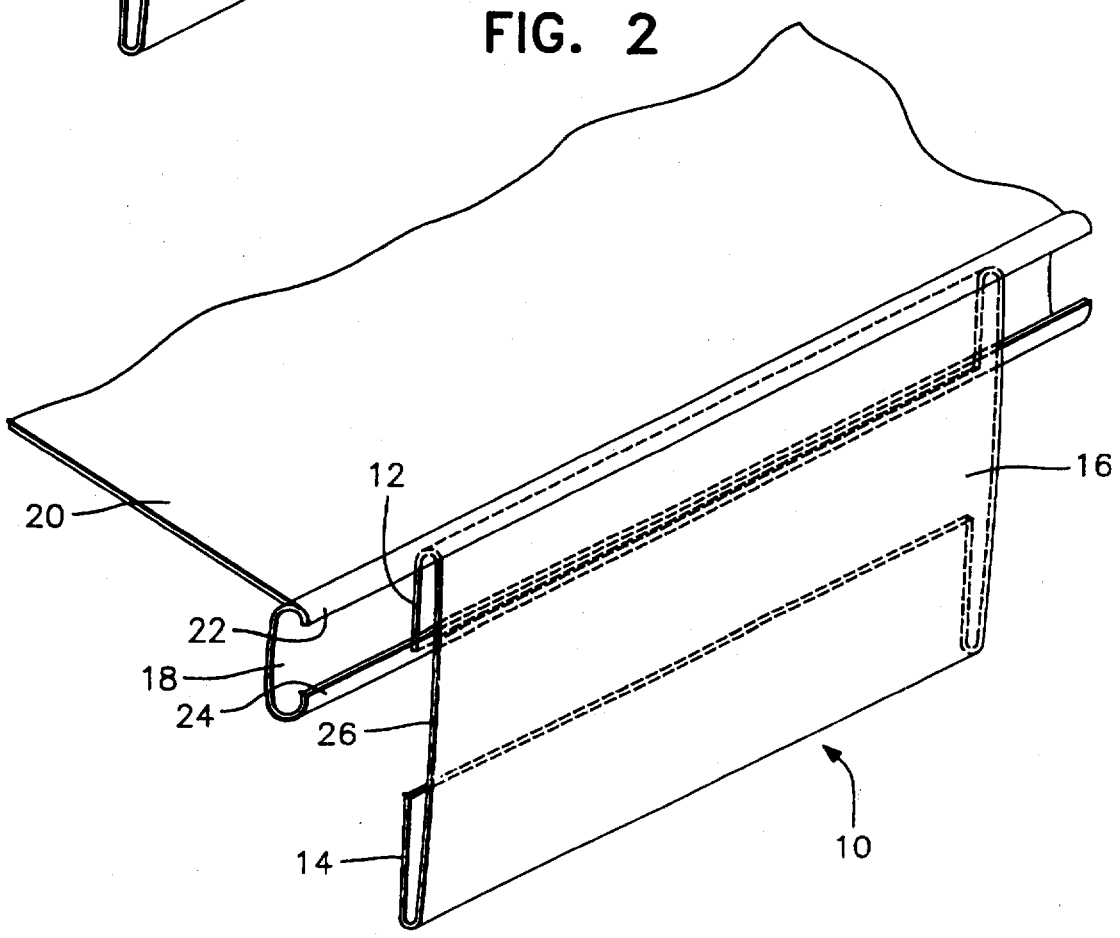
FIG. 2 is a perspective view of the sign holder mounted in a C-channel at the front of a merchandise display shelf.

A sign holder 10 according to the invention is cut, e.g. by guillotine, from a strip of suitable width plastic sheeting, which is heat-folded along its top and bottom sections to provide flaps 12, 14 of differing heights respectively. The completed sign holder thus comprises a main body panel 16 having a front face and a back face, upper and lower edges and the flaps 12, 14 folded backwardly at the upper and lower edges so as to effectively parallel the main body panel. Furthermore, the heights of the respective flaps are adapted to respective C-channels of differing heights so that each flap can be securely fitted in the respective C-channel as shown in FIG. 2. In one embodiment, for example, the main body panel 16 may have a height of 3⅝", flap 12 may have a height of 1 15/64" and flap 14 may have a height of 19/32". The height of the body panel may be chosen to fit a sign or label of a certain height between the flaps.

FIG. 2 shows the sign holder attached to a C-channel 18 formed along the front of a merchandise display shelf 20. The C-channel has upper and lower lips 22, 24 and the flap 12 is securely fitted therebetween to form a hooking tongue, the height of flap 12 being adapted to the height of channel 18. When attached, the holder depends downwardly from flap 12 to a level below channel 18 and flap 14 forms a pocket enabling a non-adhesive sign 26 or the like of suitable height to be fitted between flaps 12 and 14 against the back face of body panel 16.

For a shelf having a somewhat wider C-channel, the sign holder can be reversed and flap 14 used for hooking the holder in the C-channel rather than flap 12. It is evident therefore that the invention provides a simple and economical sign holder which can be used with equal effectiveness on shelves having different size C-channels.

Depending on the respective heights of the flaps, the holder can be designed for use in C-channels of nominally different widths or in C-channels having nominally the same width but containing slight variations in the width.

While only a preferred embodiment of the invention has been described herein in detail, the invention is not limited thereby and modifications can be made within the scope of the attached claims.

I claim:

1. In combination, a merchandise display shelf having an elongated front edge, a C-channel depending from said front edge of said shelf, said C-channel comprising a central section including a front face and upper and lower edge portions, an upper lip extending forwardly from said upper edge portion of said central section of said C-channel and defining, together with said front face, a downwardly opening, sign holder-receiving, channel, and a lower lip extending forwardly from said lower edge portion of said central section and defining, together with said front face, an upwardly opening, sign holder-receiving, channel spaced from, and aligned with, said downwardly opening channel, and a sign holder comprising a transparent body panel having a front face and a back face with spaced edge portions, a flap extending behind, and in spaced parallel relation, to said back face of said body panel of said sign holder from each of said body panel edge portions, said flaps each comprising a terminal free edge portion and a bight portion integrally connecting said flap to said body panel at a respective body panel edge portion, said flaps, together with said back face of said body panel of said sign holder, defining opposing, aligned, sign-receiving channels, the height of one of said flaps between its bight portion and its free edge portion being different from the height of the other of said flaps between its bight portion and its free edge portion, and the height of said body panel between its spaced edge portions being greater than the sum of said heights of said flaps, said bight portion of one of said flaps being engaged within one of said sign holder-receiving channels of said C-channel, and said free edge portions of said one flap being engaged within the other of said sign holder-receiving channels to thereby removably secure said one flap in said C-channel with portions of said body panel of said sign holder extending in front of, and beyond, the lip defining said other sign holder-receiving channel, whereby said one flap of said sign holder may be removed from its engagement within said sign holder-receiving channels of said C-channel and said sign holder inverted to engage the other of said flaps in a C-channel of a different height.

2. The combination as claimed in claim 1 wherein said sign holder is formed of a plastic sheet material and said flaps are defined by folds in the plastic.

3. The combination as claimed in claim wherein said flaps have heights of 1 15/16" and 1 9/32" respectively.

4. The combination as claimed in claim 3 wherein said body panel of said sign holder has a height of 3 5/8".

5. The combination as claimed in claim 1 further including a sign fitted between said sign-receiving channels of said sign holder against said back face of said body panel.

* * * * *